US005561917A

United States Patent [19]

Ratajczek

[11] Patent Number: 5,561,917

[45] Date of Patent: Oct. 8, 1996

[54] SLUDGE DRIER

[76] Inventor: William J. Ratajczek, Rte. 1, P.O. Box 1173, Trempealeau, Wis. 54661

[21] Appl. No.: 212,356

[22] Filed: Mar. 14, 1994

[51] Int. Cl.[6] ..... F26B 7/00

[52] U.S. Cl. ..... 34/384; 241/261.2; 241/261.3; 34/60; 34/136; 110/226

[58] Field of Search ..... 34/380, 381, 384, 34/386, 387, 388, 60, 135, 136; 110/222, 221, 223, 226; 241/261.2, 261.3

[56] References Cited

PUBLICATIONS

Author: Unknown; "Sprout–Bauer Processing Equipment and Systems"; 1987; ©Combustion Engineering; see p. 8.

*Primary Examiner*—Henry A. Bennett

*Assistant Examiner*—Susanne C. Tinker

*Attorney, Agent, or Firm*—Robert J. Harter

[57] ABSTRACT

A paper sludge drier includes a somewhat attrition style mill discharging to a horizontal, rotary drum drier. The mill has two mill plates facing each other. As one rotates relative to the other, sludge is broken down as it passes between the plates. The sludge flows generally from the center of the plates and outward through grooves running radially across the plates. The sludge is subsequently dried in the horizontal drum which has an integral internal screw that conveys the sludge through the drum. The sludge drier reduces the moisture content of the paper sludge from over 50 percent down to less than 20 percent.

3 Claims, 2 Drawing Sheets

SLUDGE DRIER

BACKGROUND OF THE INVENTION

1. Field of the Invention

The subject invention pertains to processing paper sludge and more specifically to a method of shearing, expanding and drying paper sludge.

2. Description of Related Art

Current methods of handling paper sludge essentially involves direct disposal of it. However this has a negative environmental impact.

SUMMARY OF THE INVENTION

To offer an alternative to direct disposal of paper sludge, it is an object of the invention to pretreat the sludge using a mill designed to tear apart the sludge as opposed to using a drum mill that might compress the sludge into large clumps.

Another object is to use a mill designed to simultaneously expand and tear apart paper sludge into pieces small enough to be readily dried.

Another object is to use mill plates having open channels to prevent clogging between the plates.

Another object is to use a substantially horizontal drying drum.

Another object is to drive a drying drum with a variable speed motor to vary the time it takes the sludge to pass through the drum.

These and other objects of the invention are provided by a novel sludge drier having a mill with two facing mill plates that convey paper sludge from a rotational center radially outward to discharge the sludge to a rotary drum drier. The sludge drier reduces the moisture content of paper sludge from more than 50 percent to less than 20 percent.

DESCRIPTION OF THE PREFERRED EMBODIMENT

Figure 1:
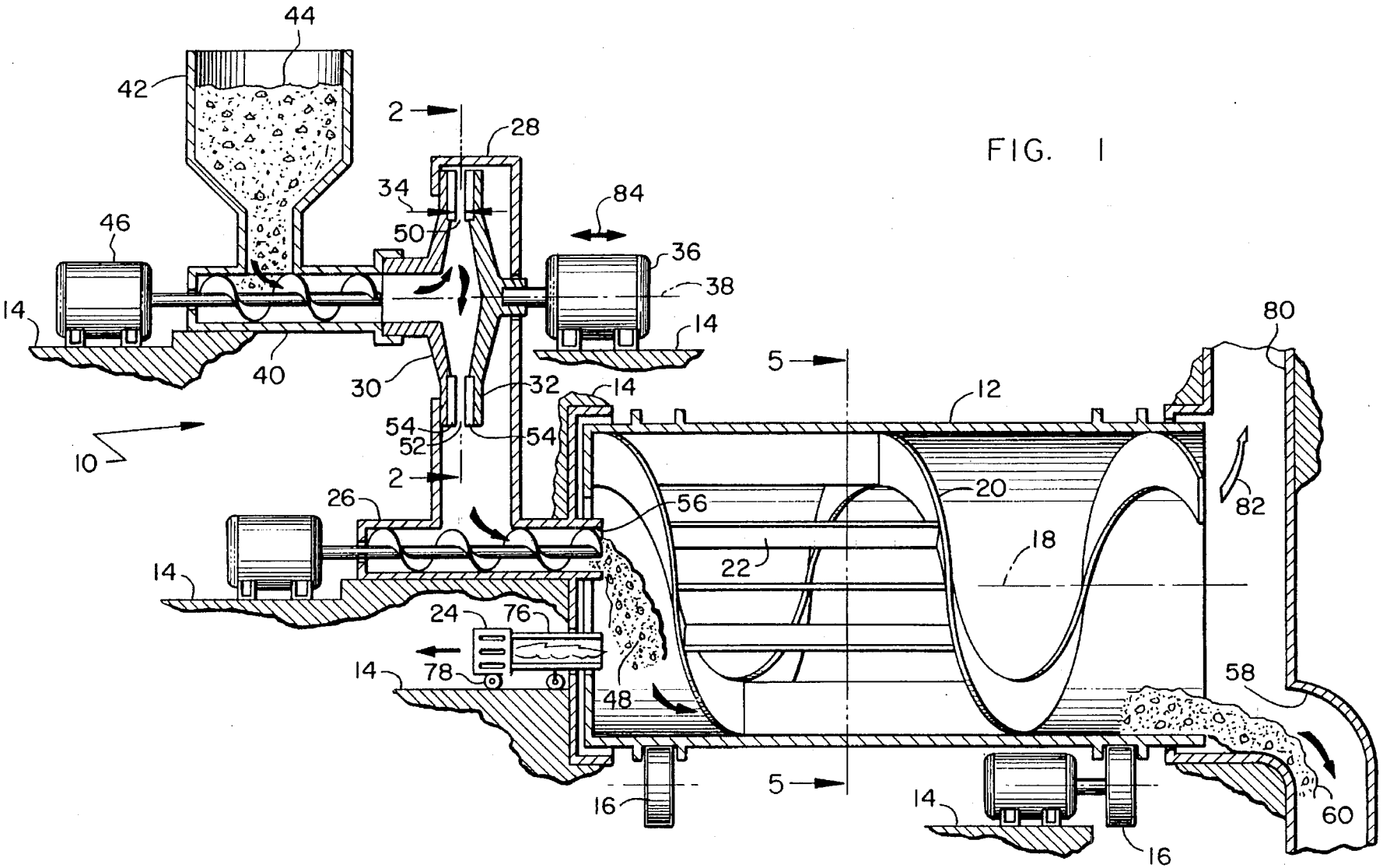
FIG. 1 is a schematic cross-sectional front view of the invention.

A sludge dryer 10 of FIG. 1 includes a drum 12 rotatably mounted relative to a frame 14 by way of a plurality of rollers 16. Drum 12 is rotatable about its longitudinal centerline 18. An internal feed screw 20 and a plurality of pickup flights 22 are attached to the interior of drum 12. Drum 12 is in heat exchange relationship with a heater 24. A first auger 26 places drum 12 in fluid communication with a mill 28. Mill 28 has a first mill plate 30 spaced 0.625" to 0.750" (gap dimension 34) away from a second mill plate 32. Second mill plate 32 is rotatably driven by a motor 36 about a rotational center 38. A second auger 40 couples first mill plate 30 to a hopper 42.

In operation, incoming sludge 44 is supplied to hopper 42. In one embodiment of the invention, incoming sludge 44 is a paper sludge consisting of a mixture of plant fiber and liquid such as water. The moisture content of incoming sludge 44 is at least 50 percent, i.e., the weight of the liquid comprises at least half of the total weight of incoming sludge 44.

Second auger 40 driven by a variable speed motor 46 conveys incoming sludge 44 toward the rotational center 38 of mill 28. Incoming sludge 44 becomes in process sludge 48 upon passing between first mill plate 30 and second mill plate 32. In process sludge 48 is slung radially outward and tends to tear apart as it travels between mill plates 30 and 32 from a mill sludge inlet 50 to a mill sludge outlet 52 at a peripheral edge 54 of mill plates 30 and 32.

First auger 26 conveys in process sludge 48 from mill 28 to drum 12 through a drum sludge inlet 56. As drum 12 rotates, feed screw 20 and pickup flights 22 convey in-process sludge 48 from drum sludge inlet 56 to a drum sludge outlet 58. Heater 24 dries in-process sludge 48 as it passes through drum 12. During the milling and drying process, in-process sludge 48 is expanded and dried to produce processed sludge 60 having a moisture content of less than 20 percent, i.e., less than 20 percent of the total weight of processed sludge 60 is comprised of liquid.

Figure 2:
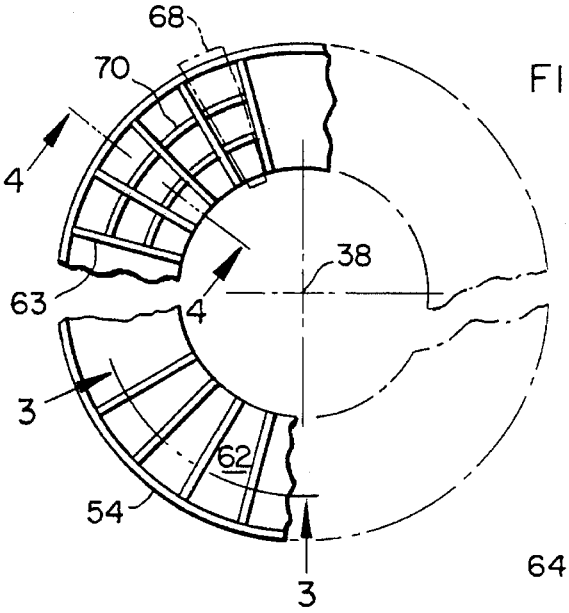
FIG. 2 is a dual cross-sectional view of the mill of FIG. 1 showing the face side of two different embodiments of a mill plate.
Figure 3:
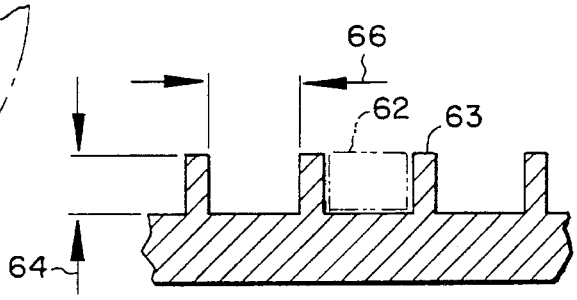
FIG. 3 is a cross-sectional view of one embodiment of FIG. 2.
Figure 4:
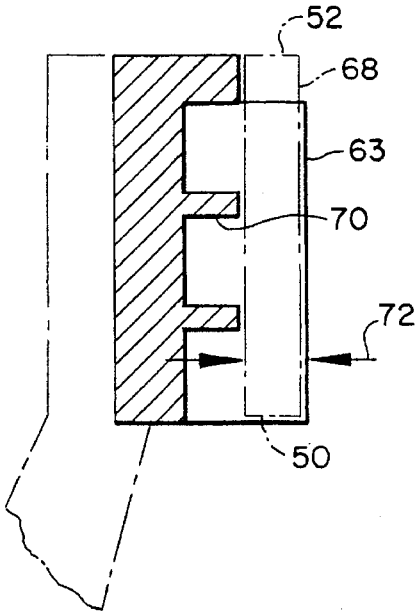
FIG. 4 is a cross-sectional view of a second embodiment of FIG. 2.

A key feature to the successful operation of this process lies in the unique design of mill plates 30 and 32. FIG. 2 shows two designs of second mill plate 32 (although both plates 30 and 32 are quite similar). Sludge flow channels 62, between a plurality of radial ribs 63, run radially uninterrupted from mill sludge inlet 50 to mill sludge outlet 52. Open channels 62, shown also in FIG. 3, allow in-process sludge 48 to be simultaneously sheared and expanded as it passes between mill plates 30 and 32. Successful operation was found to occur with a channel depth 64 of at least 0.25 inches and a channel width 66 of at least 0.25 inches. The upper half of FIG. 2 shows another embodiment where channels 68 run uninterrupted over the top of a plurality of circumferential ribs 70. Again, depth 72 (FIG. 4) is at least 0.25 inches.

Figure 5:
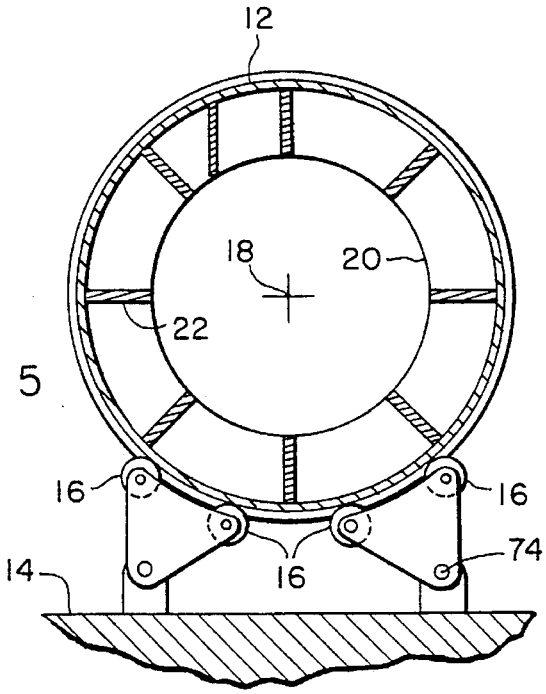
FIG. 5 is a cross-sectional view of FIG. 1.

Another feature of the invention is shown in FIG. 5. Rollers 16 are allowed to pivot about a pivotal axis 74 that runs substantially parallel to longitudinal axis 18. This pivotal action compensates for possible circular irregularities of drum 12.

Another feature of the invention includes a gas burner 76 type heater with a roll-away feature 78 for serviceability (see FIG. 1). In the illustrated embodiment, burner 76 discharges directly into drum 12. Both burnt fuel and moisture from in-process sludge 48 exhausts through exhaust 80 as indicated by arrow 82.

Also, gap 34 between mill plates 30 and 32 is adjustable as indicated by arrow 84.

It should be mentioned that this invention is not limited to processing only paper sludge, other types of sludge could also be processed such as sewage sludge having an appreciable amount of human animal waste matter. Another type of sludge could be a soil mixture.

Although the invention is described with respect to a preferred embodiment, modifications thereto will be apparent to those skilled in the art. Therefore, the scope of the invention is to be determined by reference to the claims which follow.

I claim:

1. A drying method comprising the steps of:

feeding a sludge toward a rotational center of a first mill plate, said first mill plate facing a second mill plate and being rotatable relative thereto, said sludge consisting of a mixture of a solid and a liquid with a moisture content of at least 50 percent, whereby the weight of said sludge consists of at least 50 percent liquid;

conveying said sludge radially outward away from said rotational center, between said first mill plate and said second mill plate, to beyond a peripheral edge of said first mill plate, such that said sludge passes through a plurality of channels in said first mill plate and said second mill plate, said plurality of channels having a depth of at least 0.25 inches, and said first mill plate being .spaced apart from said second mill plate by a distance of 0.625 to 0.750 inches;

conveying said sludge through a rotating drum; and delivering heat to said drum to dry said sludge to a moisture content of less than 20 percent liquid by weight.

2. A sludge dryer for processing a sludge comprising;

a frame;

a drum having a drum sludge inlet for receiving said sludge and a drum sludge outlet for discharging said sludge therethrough;

a plurality of rollers attached to said frame and supporting said drum to render said drum rotatable about a longitudinal centerline of said drum;

a heater in heat exchange relationship with said drum;

a first auger coupled to convey said sludge to said drum sludge inlet;

a first mill plate having a mill sludge inlet therethrough;

a second mill plate facing said first mill plate and being spaced apart therefrom to define a mill sludge outlet extending along a peripheral edge of said first mill plate and in fluid communication with said first auger, said second mill plate being rotatable relative to said first mill plate;

a second auger coupled to convey said sludge to said mill sludge inlet; and a plurality of radial ribs on a side of said first mill plate that faces said second mill plate, said plurality of radial ribs defining a plurality of sludge flow channels in said first mill plate running from said mill sludge inlet toward said mill sludge outlet, said plurality of sludge flow channels having a minimum depth of at least 0.25 inches.

3. The sludge dryer of claim 1 further comprising a plurality of circumferential ribs on said side of said first mill plate that faces said second mill plate, said plurality of circumferential ribs extending between said plurality of radial ribs and protruding outward to reach said minimum depth.

* * * * *